US008585278B2

(12) United States Patent
Takahashi et al.

(10) Patent No.: US 8,585,278 B2
(45) Date of Patent: Nov. 19, 2013

(54) MICRO FLUIDIC DEVICE AND FLUID CONTROL METHOD

(75) Inventors: Mutsuya Takahashi, Kanagawa (JP); Masaki Hirota, Kanagawa (JP); Takayuki Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 717 days.

(21) Appl. No.: 12/575,136

(22) Filed: Oct. 7, 2009

(65) Prior Publication Data

US 2010/0229987 A1 Sep. 16, 2010

(30) Foreign Application Priority Data

Mar. 16, 2009 (JP) ..... 2009-063109

(51) Int. Cl.
*B01F 5/02* (2006.01)

(52) U.S. Cl.
USPC ..... 366/181.5; 366/339

(58) Field of Classification Search
USPC ..... 366/339, 181.5
See application file for complete search history.

(56) References Cited

U.S. PATENT DOCUMENTS

| | | | | |
|---|---|---|---|---|
| 3,424,437 | A * | 1/1969 | Shearer | 366/339 |
| 3,860,217 | A | 1/1975 | Grout | |
| 4,050,676 | A * | 9/1977 | Morishima et al. | 366/339 |
| 5,061,544 | A | 10/1991 | Wada et al. | |
| 5,087,330 | A | 2/1992 | Wada et al. | |
| 5,783,129 | A | 7/1998 | Shirai et al. | |
| 5,938,333 | A | 8/1999 | Kearney | |
| 6,082,891 | A | 7/2000 | Schubert et al. | |
| 6,186,660 | B1 | 2/2001 | Kopf-Sill et al. | |
| 6,245,249 | B1 | 6/2001 | Yamada et al. | |
| 6,355,173 | B1 | 3/2002 | den Bieman et al. | |
| 6,361,824 | B1 | 3/2002 | Yekimov et al. | |
| 6,368,871 | B1 | 4/2002 | Christel et al. | |
| 6,616,327 | B1 | 9/2003 | Kearney et al. | |
| 6,818,394 | B1 | 11/2004 | O'Donnell-Maloney et al. | |

(Continued)

FOREIGN PATENT DOCUMENTS

| | | |
|---|---|---|
| EP | 1 481 724 A1 | 12/2004 |
| EP | 1 577 000 A2 | 9/2005 |

(Continued)

OTHER PUBLICATIONS

Notification of Reasons for Refusal for priority Japanese Patent Application No. 2009-063109, dated Feb. 24, 2011 (w/ English translation).

(Continued)

*Primary Examiner* — David Sorkin
(74) *Attorney, Agent, or Firm* — Oliff & Berridge, PLC

(57) ABSTRACT

A micro fluidic device is provided, the micro fluidic device including: at least one first introduction pipe into which first fluid is introduced; at least one second introduction pipe into which second fluid is introduced, the second introduction pipe being disposed adjacent to the first introduction pipe; a common channel connected to the first introduction pipe and the second introduction pipe, wherein in the common channel the first fluid and the second fluid are mixed; and a first group of rectification parts, the rectification parts of the first group being provided individually for the first introduction pipe or the second introduction pipe and generating a helical flow in the first fluid and the second fluid, wherein the helical flow in the first fluid and the helical flow in the second fluid have a same circumferential direction.

8 Claims, 14 Drawing Sheets

(56) References Cited

U.S. PATENT DOCUMENTS

| | | | | |
|---|---|---|---|---|
| 7,449,159 | B2 * | 11/2008 | Nomura et al. | 422/224 |
| 8,147,121 | B2 * | 4/2012 | Lacy et al. | 366/134 |
| 2002/0058332 | A1 | 5/2002 | Quake et al. | |
| 2003/0008308 | A1 | 1/2003 | Enzelberger et al. | |
| 2004/0213083 | A1 | 10/2004 | Fujiwara et al. | |
| 2005/0163701 | A1 | 7/2005 | Tonkovich et al. | |
| 2005/0167354 | A1 | 8/2005 | Caze et al. | |
| 2005/0207952 | A1 | 9/2005 | Mae | |
| 2005/0207953 | A1 | 9/2005 | Upadhye et al. | |
| 2006/0073080 | A1 | 4/2006 | Tonkovich et al. | |
| 2006/0140829 | A1 | 6/2006 | Tabata et al. | |
| 2006/0159601 | A1 | 7/2006 | Yamada et al. | |
| 2006/0272722 | A1 | 12/2006 | Yamada et al. | |
| 2007/0062856 | A1 | 3/2007 | Pahl et al. | |
| 2007/0139451 | A1 | 6/2007 | Somasiri et al. | |
| 2007/0183933 | A1 | 8/2007 | Kawazoe et al. | |
| 2007/0256736 | A1 | 11/2007 | Tonkovich et al. | |
| 2007/0286795 | A1 | 12/2007 | Chiba et al. | |
| 2008/0226517 | A1 | 9/2008 | Vitucci et al. | |
| 2008/0245745 | A1 | 10/2008 | Ward et al. | |
| 2009/0130025 | A1 | 5/2009 | Bohmer et al. | |
| 2010/0008179 | A1 * | 1/2010 | Lacy et al. | 366/134 |
| 2010/0068366 | A1 | 3/2010 | Tonkovich et al. | |

FOREIGN PATENT DOCUMENTS

| | | | |
|---|---|---|---|
| EP | 1 767 268 | A1 | 3/2007 |
| JP | A-50-2256 | | 1/1975 |
| JP | B-H06-37291 | | 5/1994 |
| JP | A-09-512742 | | 12/1997 |
| JP | A-10-305488 | | 11/1998 |
| JP | A-10-512197 | | 11/1998 |
| JP | A-2000-506432 | | 5/2000 |
| JP | A-2000-238000 | | 9/2000 |
| JP | A-2001-509728 | | 7/2001 |
| JP | A-2002-527250 | | 8/2002 |
| JP | A-2002-292274 | | 10/2002 |
| JP | A-2003-194806 | | 7/2003 |
| JP | A-2004-154648 | | 6/2004 |
| JP | A-2004-223637 | | 8/2004 |
| JP | A-2004-330008 | | 11/2004 |
| JP | A-2004-344877 | | 12/2004 |
| JP | A-2004-354180 | | 12/2004 |
| JP | A-2004-358602 | | 12/2004 |
| JP | A-2005-028267 | | 2/2005 |
| JP | A-2005-072652 | | 3/2005 |
| JP | A-2005-144634 | | 6/2005 |
| JP | A-2005-152763 | | 6/2005 |
| JP | A-2005-246294 | | 9/2005 |
| JP | A-2005-262053 | | 9/2005 |
| JP | A-2006-015254 | | 1/2006 |
| JP | A-2006-061870 | | 3/2006 |
| JP | A-2006-088077 | | 4/2006 |
| JP | A-2006-095515 | | 4/2006 |
| JP | A-2006-150347 | | 6/2006 |
| JP | A-2006-161717 | | 6/2006 |
| JP | A-2006-167612 | | 6/2006 |
| JP | A-2006-187684 | | 7/2006 |
| JP | A-2006-187685 | | 7/2006 |
| JP | A-2006-272231 | | 10/2006 |
| JP | A-2006-272232 | | 10/2006 |
| JP | A-2006-305505 | | 11/2006 |
| JP | A-2006-341140 | | 12/2006 |
| JP | A-2007-100072 | | 4/2007 |
| JP | A-2007-105667 | | 4/2007 |
| JP | A-2007-519510 | | 7/2007 |
| JP | A-2007-252979 | | 10/2007 |
| JP | A-2007-260678 | | 10/2007 |
| JP | T-2008-514428 | | 5/2008 |
| JP | A-2008-168173 | | 7/2008 |
| WO | WO 95/30476 | | 11/1995 |
| WO | WO 97/14497 | | 4/1997 |
| WO | WO 00/22436 | | 4/2000 |
| WO | WO 2006/039568 | A1 | 4/2006 |
| WO | WO 2006/046202 | A1 | 5/2006 |
| WO | WO 2006/087655 | A1 | 8/2006 |

OTHER PUBLICATIONS

Jun. 4, 2012 Office Action issued in U.S. Appl. No. 11/905,931.
Feb. 16, 2012 Office Action issued in U.S. Appl. No. 12/196,783.
Feb. 6, 2012 Office Action issued in U.S. Appl. No. 11/783,394.
May 22, 2012 Office Action issued in Japanese Patent Application No. 2007-080768 (with translation).
Jul. 25, 2012 Office Action issued in U.S. Appl. No. 11/783,394.
Sep. 26, 2011 Office Action issued in Japanese Application No. 2007-275991 (with translation).
Takei et al. "Sub-Nano Litter Micro Batch Operation Systems With Multi-Step Laplace Pressure Valves Prepared by Photocatalytic Analog Lithography", The 10th International Conference on Miniaturized Systems for Chemistry and Life Science, Nov. 5-9, 2006, pp. 245-247, Tokyo, Japan.
Hideo Yoshida; "Surface Tension", Proceedings of the TEDCOF. '01, Japan Society of Mechanical Engineers, 2001, pp. 1-5.
Oct. 17, 2011 Office Action issued in U.S. Appl. No. 12/196,783.
Oct. 27, 2009 Office Action issued in U.S. Appl. No. 11/905,931.
Mar. 22, 2010 Office Action issued in U.S. Appl. No. 11/905,931.
May 11, 2011 Office Action issued in U.S. Appl. No. 11/905,931.
Sep. 16, 2011 Office Action issued in U.S. Appl. No. 11/905,931.
Miyashita et al. "Sonic Crystal Waveguide—Numerical Simulations and Experiments", Technical Report of The Institute of Electronics, Information and Communication Engineers, Jun. 2001, pp. 33-39 (with abstract).
Mizukoshi et al. "25th Lecture Summary of Surface Science Lecture Convention", The Surface Science Society Japan, Nov. 14, 2005 (with translation).
Jan. 21, 2011 Office Action issued in U.S. Appl. No. 12/185,464.
Jul. 18, 2011 Office Action issued in U.S. Appl. No. 12/185,464.
Xu Ji et al. "a Centrifugation-Enhanced High-Efficiency Micro-Filter with Spiral Channel", Transducers & Eurosensors '07, The 14th International Conference on Solid-State Sensors, Actuators and Microsystems, Lyon, France, Jun. 10-14, 2007, pp. 1865-1868.
Oct. 5, 2010 Office Action issued in Japanese Patent Application No. 2008-292428 (with translation).
Jan. 28, 2011 Office Action issued in U.S. Appl. No. 17/422,528.
May 17, 2011 Office Action issued in U.S. Appl. No. 12/422,528.
Nov. 30, 2010 Office Action issued in Japanese Patent Application No. 2006-195904 (with translation).
Aug. 20, 2009 Office Action issued in U.S. Appl. No. 11/783,394.
Jun. 8, 2010 Office Action issued in U.S. Appl. No. 11/783,394.
Mar. 25, 2011 Office Action issued in U.S. Appl. No. 11/783,394.
Oct. 13, 2011 Office Action issued in U.S. Appl. No. 11/783,394.
U.S. Appl. No. 12/196,783 in the name of Tabata et al., filed Aug. 22, 2008.
U.S. Appl. No. 12/185,464 in the name of Tabata et al., filed Aug. 4, 2008.
U.S. Appl. No. 12/422,528 in the name of Hongo et al., filed Apr. 13, 2009.
U.S. Appl. No. 11/905,931 in the name of Yamada et al., filed Oct. 5, 2007.
U.S. Appl. No. 11/783,394 in the name of Tabata et al., filed Apr. 9, 2007.
Oct. 18, 2011 Office Action issued in Japanese patent Application No. 2007-266414 (with translation).
Nov. 14, 2012 Notice of Allowance issued in U.S. Appl. No. 11/783,394.
Notification of Reason for Refusal for priority Japanese Patent Application No. 2009-63109, mailed on May 24, 2011 (w/ English translation).
Apr. 9, 2012 Office Action issued in U.S. Appl. No. 12/185,464.
Sep. 12, 2013 Office Action issued in U.S. Appl. No. 12/196,783.

* cited by examiner (FIRST EXEMPLARY EMBODIMENT)

(FIRST EXEMPLARY EMBODIMENT)

(FIRST EXEMPLARY EMBODIMENT)

(FIRST EXEMPLARY EMBODIMENT)

(FIRST EXEMPLARY EMBODIMENT)

(FIRST EXEMPLARY EMBODIMENT)
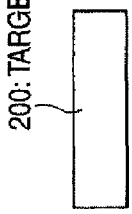
FIG. 6A
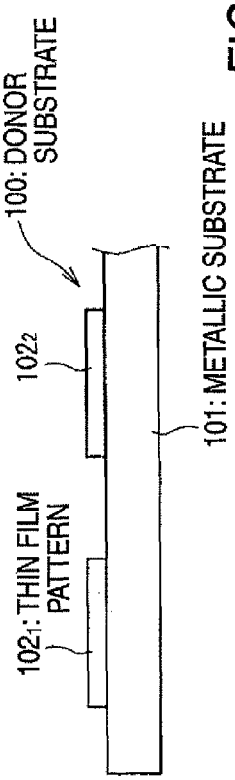
FIG. 6B
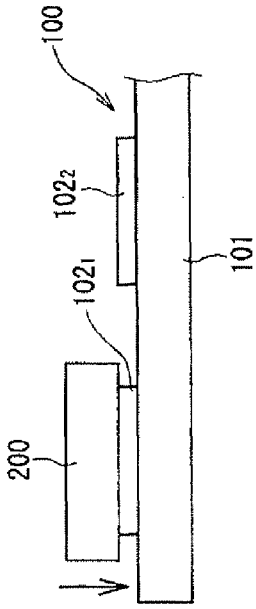
FIG. 6C
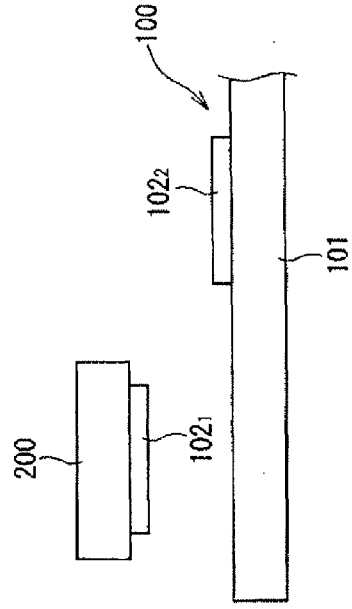
FIG. 6D
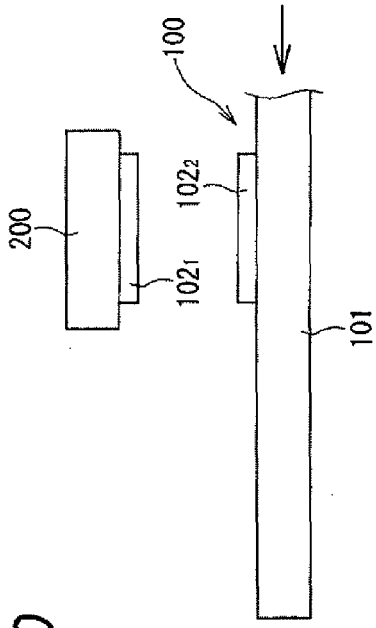
FIG. 6E
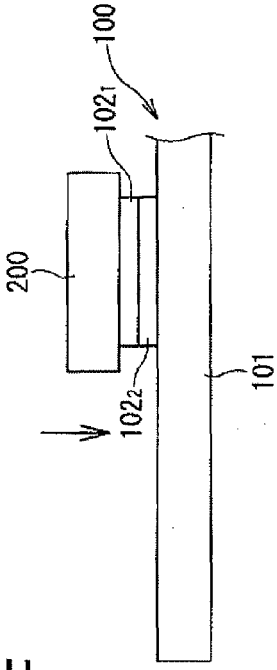
FIG. 6F
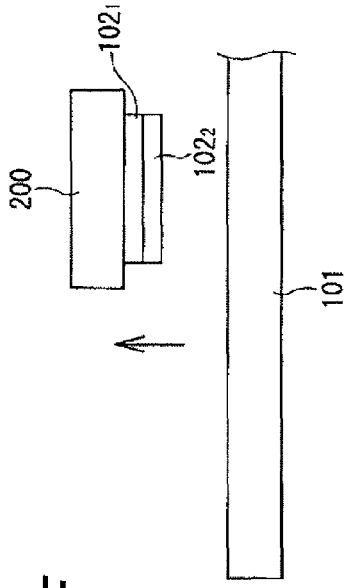

(FIRST EXEMPLARY EMBODIMENT)

(SECOND EXEMPLARY EMBODIMENT)

(SECOND EXEMPLARY EMBODIMENT)

(SECOND EXEMPLARY EMBODIMENT)

(THIRD EXEMPLARY EMBODIMENT)

MICRO FLUIDIC DEVICE AND FLUID CONTROL METHOD

CROSS-REFERENCE TO RELATED APPLICATIONS

This application is based on and claims priority under 35 U.S.C. 119 from Japanese Patent Application No. 2009-063109 filed Mar. 16, 2009.

BACKGROUND

1. Technical Field

The present invention relates to a micro fluidic device and a fluid control method.

2. Related Art

There have hitherto been known micro fluidic devices for allowing plural fluids to pass as a laminar flow through a micro channel having a diameter of, for example, not more than 0.5 mm, mixing those fluids by means of molecular diffusion and subjecting the mixture to a compound reaction.

SUMMARY

According to an aspect of the present invention, there is provided a micro fluidic device including:

at least one first introduction pipe into which first fluid is introduced;

at least one second introduction pipe into which second fluid is introduced, the second introduction pipe being disposed adjacent to the first introduction pipe;

a common channel connected to the first introduction pipe and the second introduction pipe, wherein in the common channel the first fluid and the second fluid are mixed; and a first group of rectification parts, the rectification parts of the first group being provided individually for the first introduction pipe or the second introduction pipe and generating a helical flow in the first fluid and the second fluid, wherein the helical flow in the first fluid and the helical flow in the second fluid have a same circumferential direction.

BRIEF DESCRIPTION OF THE DRAWINGS

Exemplary embodiments of the present invention will be described in detail based on the following figures, wherein:

FIGS. 4A and 4B each shows one rectification part in FIG. 3, in which FIG. 4A is a front view, and FIG. 4B is a sectional view along a B-B line in FIG. 4A;

FIGS. 6A to 6F are each a view showing manufacturing steps of a micro fluidic device according to a first exemplary embodiment of the invention;

DETAILED DESCRIPTION

[First Exemplary Embodiment]

Figure 1:
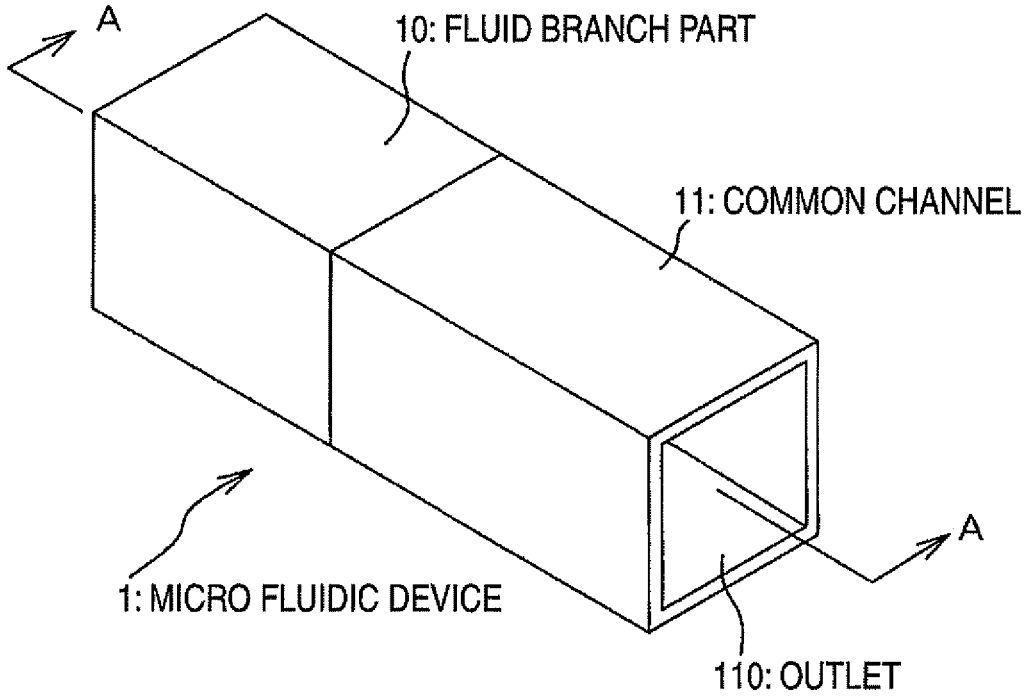
FIG. 1 is a perspective view showing an example of the whole configuration of a micro fluidic device according to a first exemplary embodiment of the invention.
Figure 2:
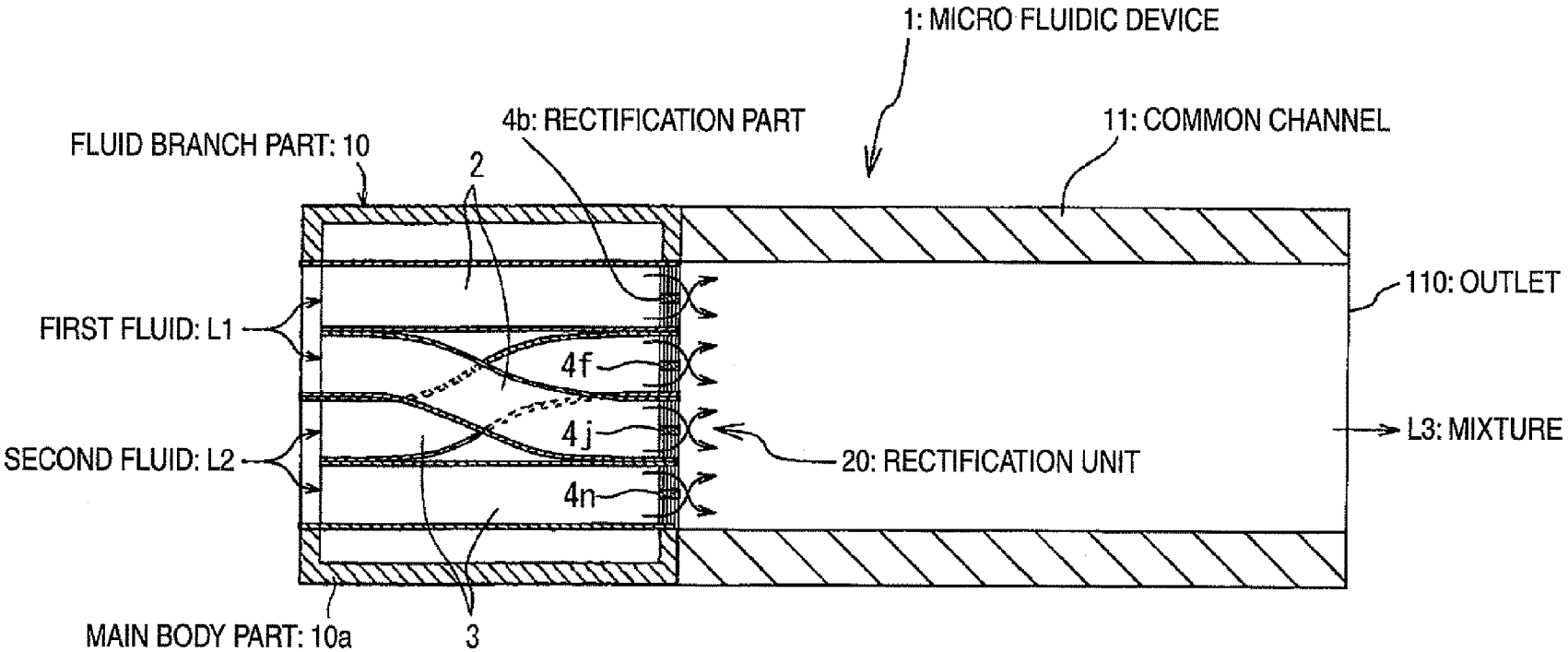
FIG. 2 is a sectional view along an A-A line in FIG. 1.

FIG. 1 is a perspective view showing an example of the whole configuration of a micro fluidic device according to a first exemplary embodiment of the invention; and FIG. 2 is a sectional view along an A-A line in FIG. 1.

This micro fluid device 1 is configured to include a fluid branch part 10 for generating a helical flow in each of introduced first fluid L1 and second fluid L2 and discharging them; and a common channel 11 for allowing the first fluid L1 and the second fluid L2 discharged from the fluid branch part 10 to pass therethrough. The first fluid L1 and the second fluid L2 are each, for example, a liquid, a powder, a gas or the like.

The micro fluid device 1 is one kind of a micro fluid apparatus for carrying out a chemical reaction between the first fluid L1 and the second fluid L2 within the common channel 11. This micro fluid apparatus includes, for example, a micro mixer or a micro reactor for merely mixing the first fluid L1 and the second fluid L2 within the common channel 11 or regulating the particle size of a powder, etc., or the like.

The common channel 11 is made of a metal (for example, Al, Ni, Cu, etc.) or a non-metal (for example, ceramics, silicon, dielectrics, etc.). The common channel 11 has a function to mix the first fluid L1 and the second fluid L2 having been discharged from a rectification unit 20 as shown in FIG. 2 and discharge the thus obtained mixture L3 from an outlet 110.

(Configuration of Rectification Part)

Figure 3:
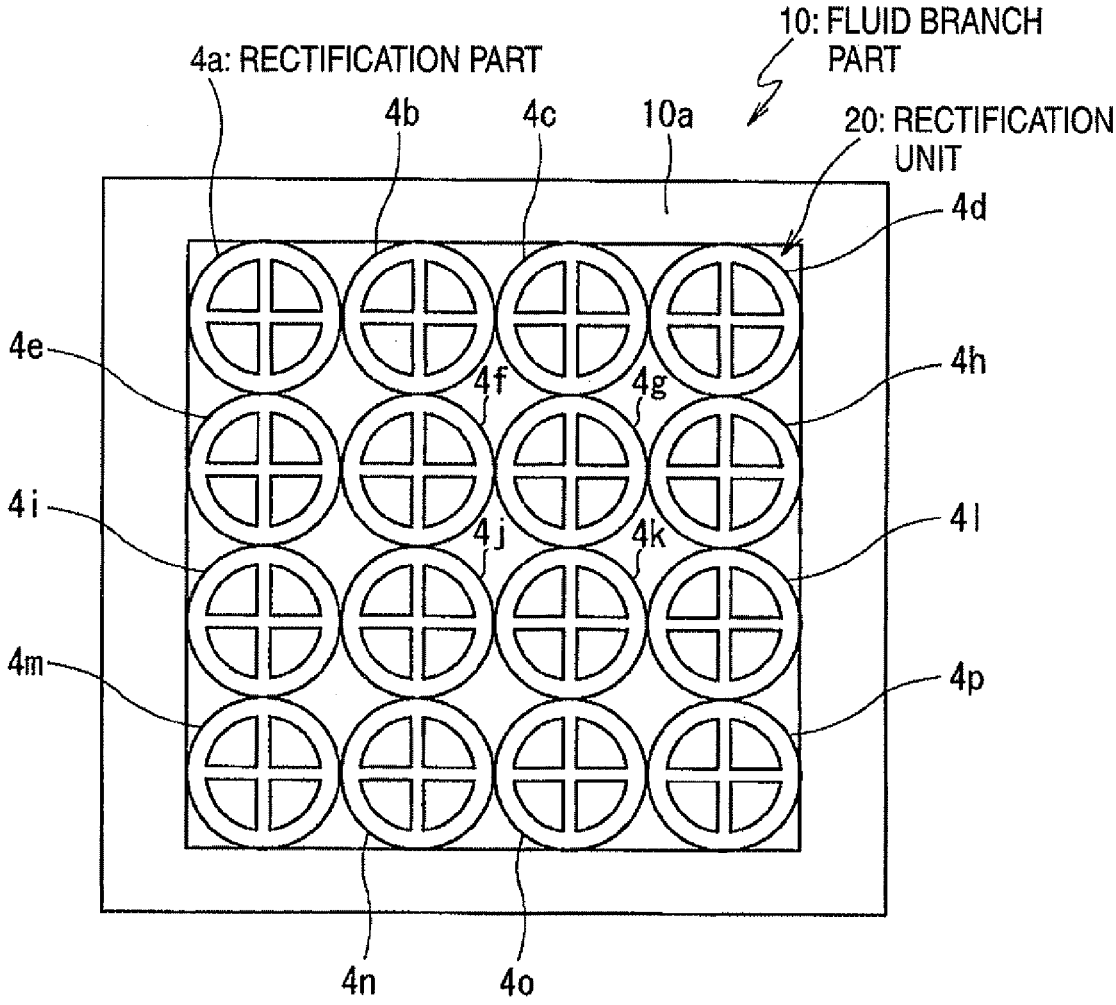
FIG. 3 is a side view showing the whole of a rectification unit in a fluid branch part seen from a common channel side of FIG. 2.

FIG. 3 is a side view showing the whole of the rectification unit seen from a common channel side of FIG. 2. The rectification unit 20 is composed of rectification parts 4*a* to 4*p* (hereinafter also referred to as "rectification part 4") having the same configuration, which generate a helical flow in the first fluid L1 and the second fluid L2 for every first introduction pipe 2 and second introduction pipe 3, and these are arranged at regular intervals on the same plane in a manner of 4 lines and 4 rows. The first introduction pipe 2 is connected to each of the rectification parts 4*a*, 4*c*, 4*f*, 4*h*, 4*i*, 4*k*, 4*n* and 4*p*; and the second introduction pipe 3 is connected to each of the rectification parts 4*b*, 4*d*, 4*e*, 4*g*, 4*j*, 4*l*, 4*m* and 4*o*. The rectification parts 4*a* to 4*p* are not limited to this number, but the number may be arbitrarily chosen depending upon an application or the like.

Figure 4A:
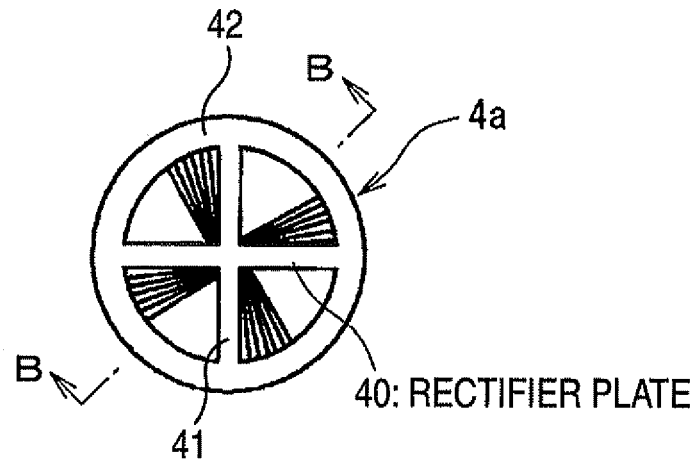
Figure 4B:
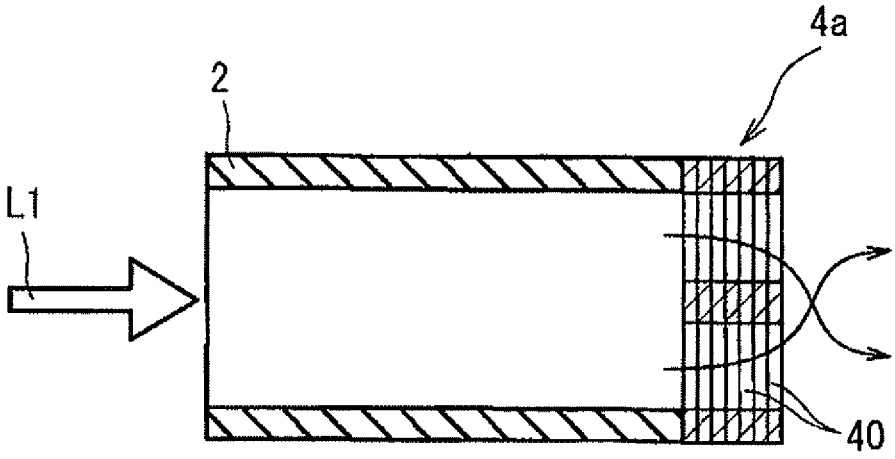

FIGS. 4A and 4B each shows one rectification part in FIG. 3, in which FIG. 4A is a front view, and FIG. 43 is a sectional view along a B-B line in FIG. 4A. As described previously, the rectification parts 4*a* to 4*p* have the same configuration. Then, the configuration of the rectification part 4*a* is herein described with reference to FIGS. 4A and 4B. The rectification part 4*a* is composed of a laminate of plural rectifier plates 40 each having a cross-shaped part 41 and a ring part 42 and provided in an outlet part of the first introduction pipe 2.

(Configuration of Donor Substrate which is Used for the Manufacture of Micro Fluidic Device)

Figure 5:
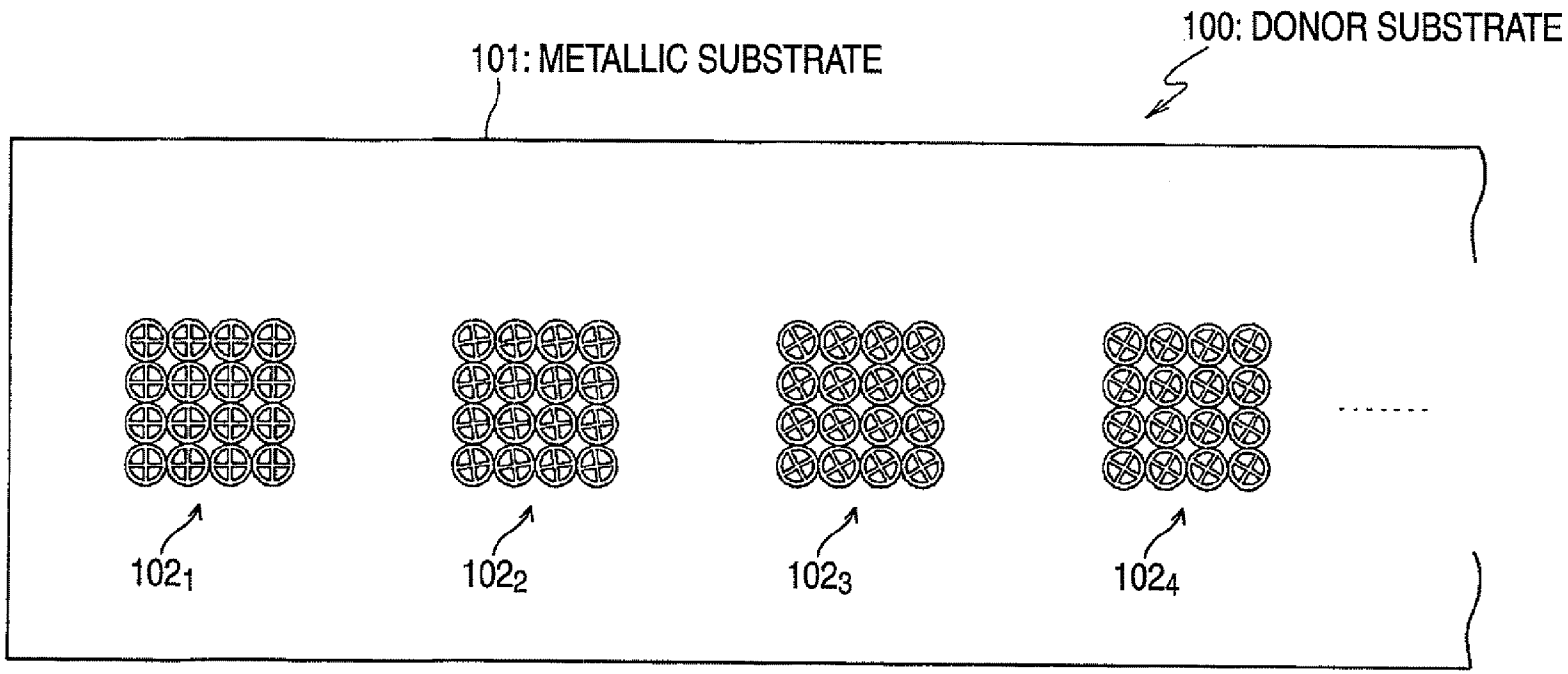
FIG. 5 is a plan view showing a configuration of a donor substrate which is used for the manufacture of a micro fluidic device according to a first exemplary embodiment of the invention.

FIG. 5 is a plan view showing a configuration of a donor substrate 100 which is used for the manufacture of a micro fluidic device. The rectification unit 20 is manufactured as follows. First all, a metallic substrate 101 made of a metal such as stainless steel is prepared, and a thick photoresist is coated on the metallic substrate 101. Subsequently, the coated surface of the thick photoresist is exposed through a photomask corresponding to each sectional shape of the micro fluidic device 1 to be fabricated, and the photoresist is developed to form a resist pattern in which positive-negative inversion of each sectional shape has taken place. Subsequently, the metallic substrate 101 having this resist pattern is dipped in a plating bath, thereby growing nickel plating on the surface of the metallic substrate 101 which is not covered by the photoresist.

Subsequently, by removing each resist pattern of the metallic substrate 101, a plural number (M) of thin film patterns $\mathbf{102}_1, \mathbf{102}_2, \ldots \mathbf{102}_M$ (hereinafter also referred to as "thin film pattern 102") are formed on the metallic substrate 101 corresponding to the respective sectional shapes of the rectification unit 20. Patterns for plural rectifier plates 40 (see FIGS. 4A and 4B) are formed on each thin film pattern. The plural thin film patterns are laminated to compose the plural rectification parts 4.

Each thin film pattern 102 on the metallic substrate 101 forms plural patterns each of which is a portion corresponding to the rectifier plate 40. The thin film pattern 102 is laminated by procedures shown in FIGS. 6A to 6F as described below, thereby fabricating the rectification unit 20.

(Manufacturing Method of Rectification Part)

FIGS. 6A to 6F are each a view showing manufacturing steps of the rectification unit 20. Here, the lamination of the thin film patterns is carried out by means of room temperature bonding. The "room temperature bonding" as referred to herein means direct bonding of atoms to each other at room temperature. First of all, as shown in FIG. 6A, a donor substrate (first substrate) 100 is disposed on a non-illustrated lower stage within a vacuum tank, and a target substrate (second substrate) 200 is disposed on a non-illustrated upper stage within the vacuum tank. Subsequently, the inside of the vacuum tank is evacuated to a high vacuum state or a super-high vacuum state. Subsequently, the lower stage is relatively moved against the upper stage, thereby locating the thin film pattern $\mathbf{102}_1$ of the donor substrate 100 just under the target substrate 200. Subsequently, the surface of the target substrate 200 and the surface of the thin film pattern $\mathbf{102}_1$ of the donor substrate 100 are cleaned upon irradiation with an argon atom beam.

Subsequently, as shown in FIG. 6B, the target substrate 200 is descended by the upper stage, and the target substrate 200 is pressed against the donor substrate 100 under a previously determined load force (for example, 10 kgf/cm$^2$) for a previously determined period of time (for example, 5 minutes), thereby subjecting the target substrate 200 and the thin film pattern $\mathbf{102}_1$ to room temperature bonding to each other.

Subsequently, as shown in FIG. 6C, when the target substrate 200 is ascended by the upper stage, the thin film pattern $\mathbf{102}_1$ is separated from the metallic substrate 101, whereby the thin film pattern $\mathbf{102}_1$ is transferred onto the side of the target substrate 200. This is because a bonding force between the thin film pattern $\mathbf{102}_1$ and the target substrate 200 is larger than a bonding force between the thin film pattern $\mathbf{102}_1$ and the metallic plate 101.

Subsequently, as shown in FIG. 6D, the donor substrate 100 is moved toward an arrow direction by the lower stage, thereby locating the second layer thin film pattern $\mathbf{102}_2$ on the donor substrate 100 just under the target substrate 200. Subsequently, the surface of the thin film pattern $\mathbf{102}_1$ having been transferred onto the side of the target substrate 200 (the surface coming into contact with the metallic substrate 101) and the surface of the second layer thin film pattern $\mathbf{102}_2$ are cleaned in the manner as described previously.

Subsequently, as shown in FIG. 6E, the target substrate 200 is descended by the upper stage, thereby bonding the thin film pattern $\mathbf{102}_1$ on the side of the target substrate 200 and the thin film pattern $\mathbf{102}_2$ to each other. Subsequently, as shown in FIG. 6F, when the target substrate 200 is ascended by the upper stage, the thin film pattern $\mathbf{102}_2$ is separated from the metallic substrate 101 and transferred onto the side of the target substrate 200. Thereafter, all of the thin film patterns $\mathbf{102}_3$ to $\mathbf{102}_M$ are transferred onto the target substrate 200 from the donor substrate 100 in the same manner.

By successively repeating registration between the donor substrate 100 and the target substrate 200, bonding and isolation in the foregoing manner, the plural thin film patterns 102 corresponding to the respective sectional shapes of the rectification unit 20 are transferred onto the target substrate 200. The target substrate 200 is removed from the upper stage, and the transferred laminate on the target substrate 200 is separated from the target substrate 200, whereby the rectification parts 4*a* to 4*p* are collectively fabricated.

The rectification parts 4*a* to 4*p* may also be fabricated by a semi-conductor process. For example, a substrate made of an Si wafer is prepared; a mold releasing layer made of a polyimide is formed on this substrate by a spin coating method; an Al thin film serving as a material of the rectifier plate is formed on the surface of this mold releasing layer by a sputtering method; and the Al thin film is subjected to sputtering by a photolithography method, thereby fabricating the donor substrate.

(Flow of Fluid in Rectification Part)

Figure 7A:
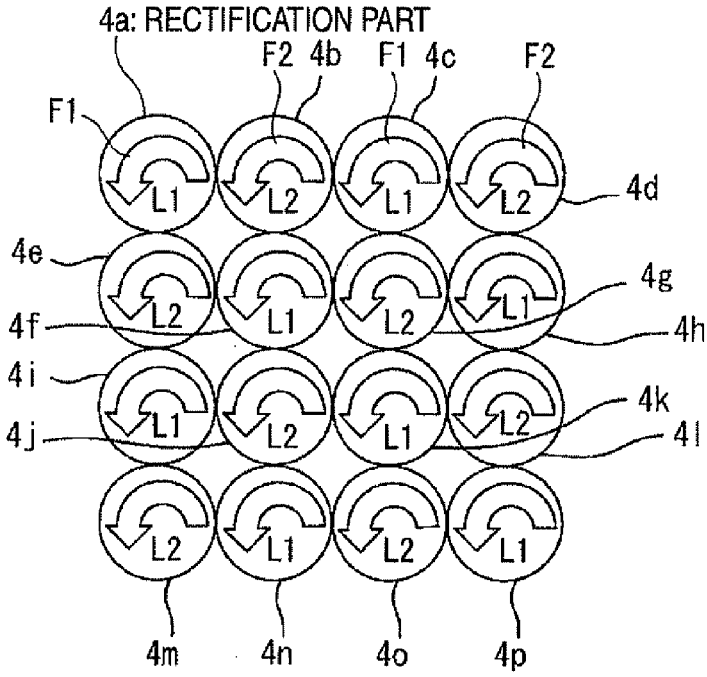
FIGS. 7A to 7C are each a view showing flows of a first fluid and a second fluid in a liquid branch part of a micro fluid device according to a first exemplary embodiment of the invention.
Figure 7B:
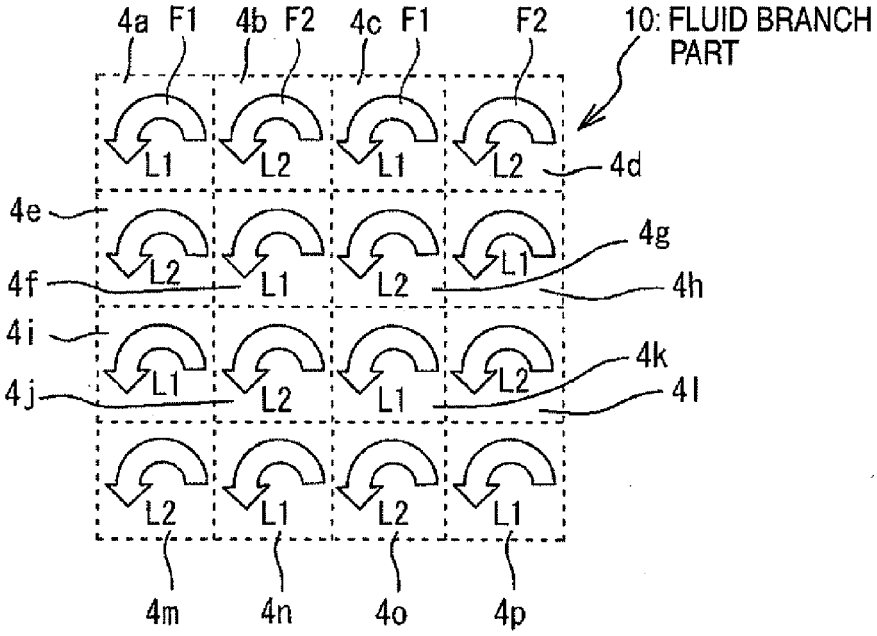
Figure 7C:
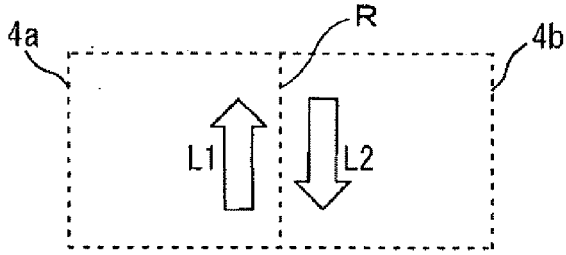

FIGS. 7A, 7B and 7C are each a view showing flows of the first fluid and the second fluid in the liquid branch part of the micro fluid device. The first fluid L1 is introduced into the first introduction pipe 2 of each of the rectification parts 4*a*, 4*c*, 4*f*, 4*h*, 4*i*, 4*k*, 4*n* and 4*p*; and the second fluid L2 is introduced into the second introduction pipe 3 of each of the rectification parts 4*b*, 4*d*, 4*e*, 4*g*, 4*j*, 41, 4*m* and 4*o*. Here, in case of the present exemplary embodiment, the first fluid L1 and the second fluid L2 include a fine particle (for example, a toner).

In passing through the rectification parts 4*a* to 4*p*, the first fluid L1 and the second fluid L2 are each rotated in a helical form by the rectifier plate 40. At outlets of the rectification parts 4*a* to 4*p*, all of a helical flow F1 of the first fluid L1 and a helical flow F2 of the second fluid L2 are generated in the same direction (here, in a counterclockwise direction) as shown in FIG. 7A.

In the first fluid L1 and the second fluid L2 immediately after coming out the rectification parts 4*a* to 7*p*, since a barrier for partitioning them from each other is not provided, the helical flow F1 and the helical flow F2 which are generated corresponding to each of the rectification parts 4*a* to 4*p* are in a state of coming into contact with each other as shown in FIG. 7B. For example, as shown in FIG. 7C, the helical flow F1 which has come out the rectification part 4*a* and the helical flow F2 which has come out the rectification part 4*b* flow in a reverse direction to each other at an interface R of the both.

Accordingly, a shear force is generated between the first fluid L1 and the second fluid L2 at the interface R, and when a shear force is applied to the first fluid L1 and the second fluid L2 and also to fine particles included therein, it becomes easy to control the size and distribution of fine particles which are discharged from the outlet 110.

Thereafter, the first fluid L1 and the second fluid L2 advance within the common channel 11 and mix, and the mixture L3 is then discharged from the outlet 110.

In the foregoing exemplary embodiment, though only the rectification part is formed by laminating the thin film pattern, the rectification part and a portion of the main body part in the surroundings thereof may be formed by laminating the thin film pattern.

[Second Exemplary Embodiment]

Figure 8:
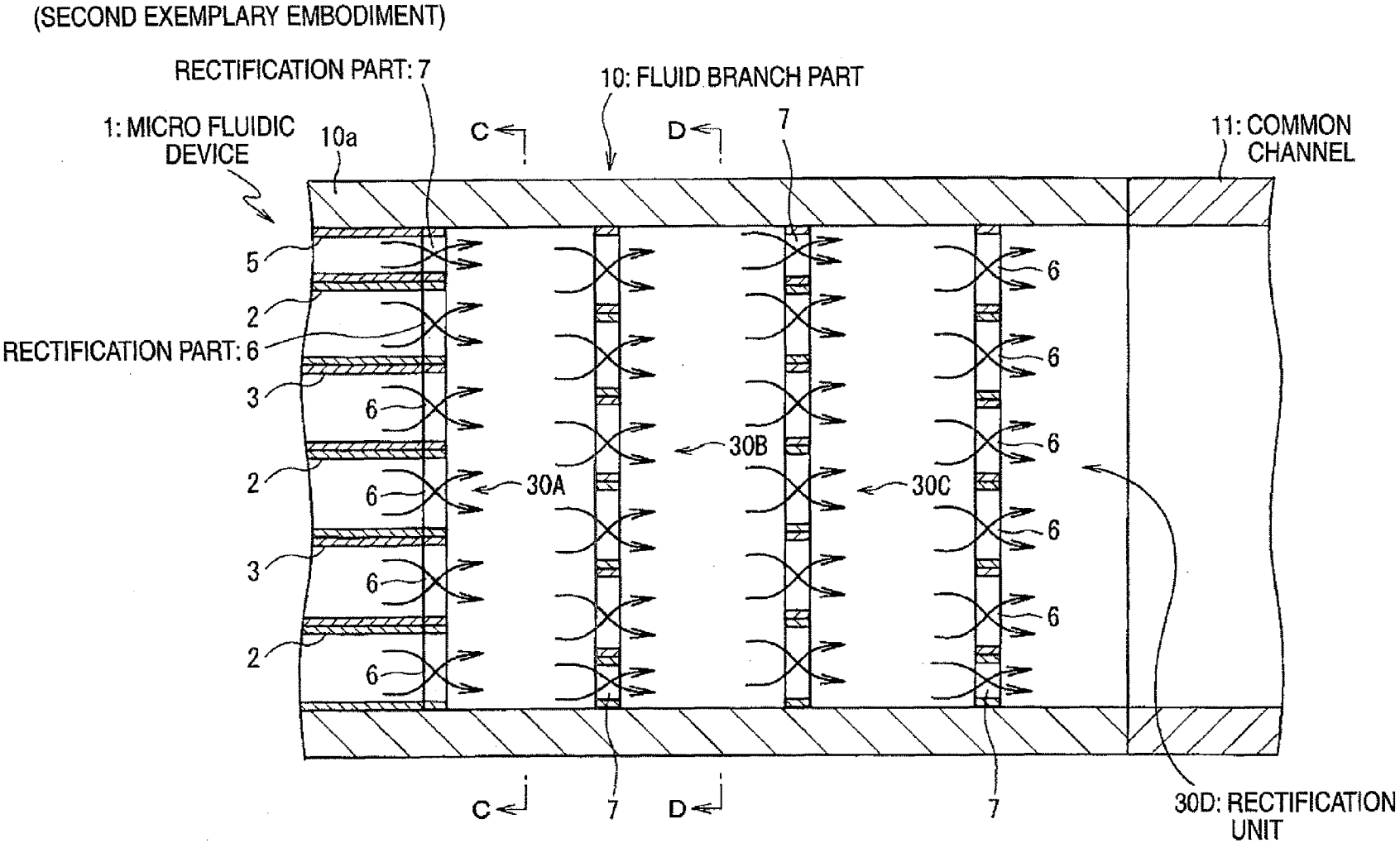
FIG. 8 is a sectional view showing a micro fluidic device according to a second exemplary embodiment of the invention.
Figure 9:
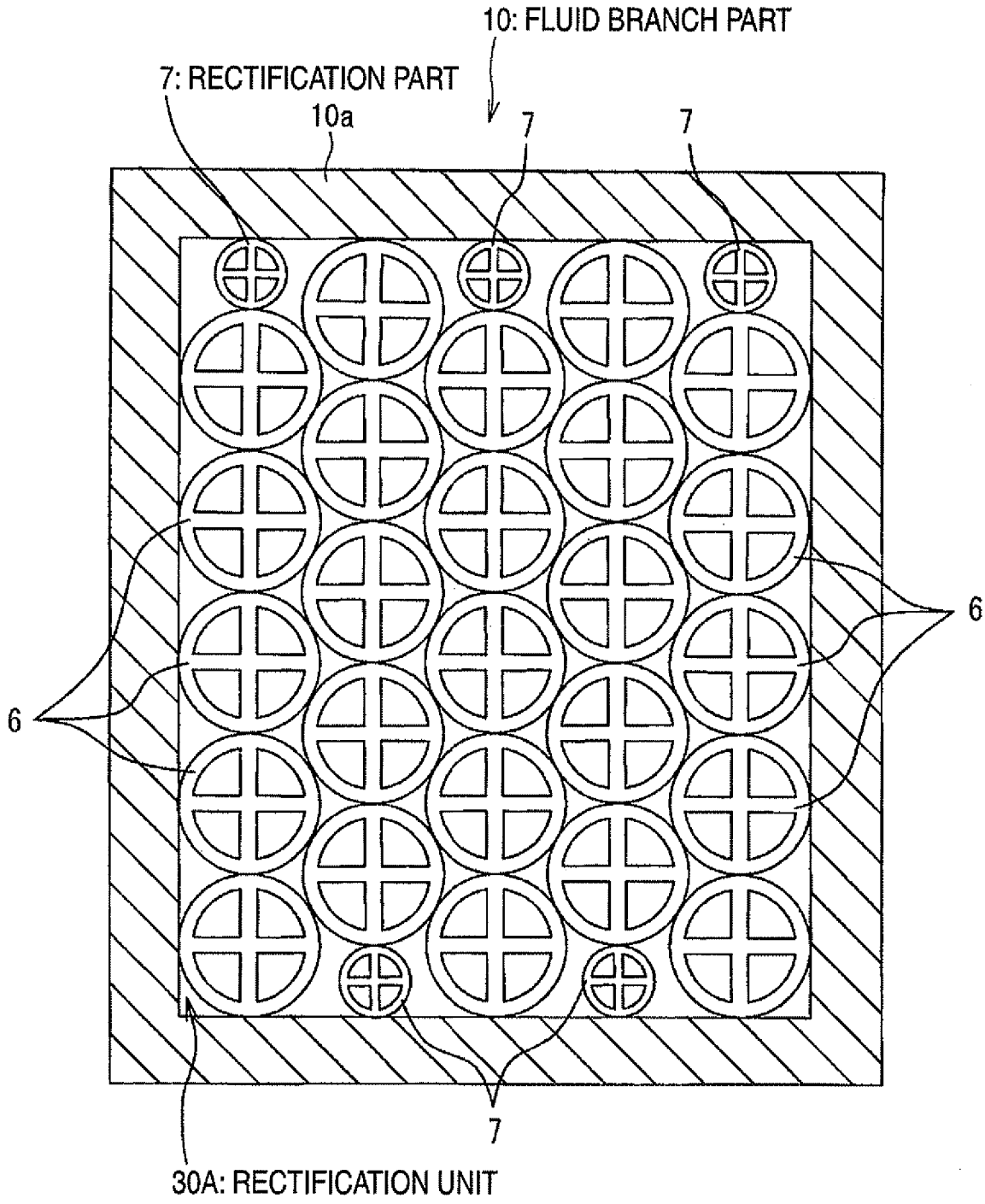
FIG. 9 is a sectional view along a C-C line in FIG. 8 as seen form a common channel (outlet) side of FIG. 8.
Figure 10:
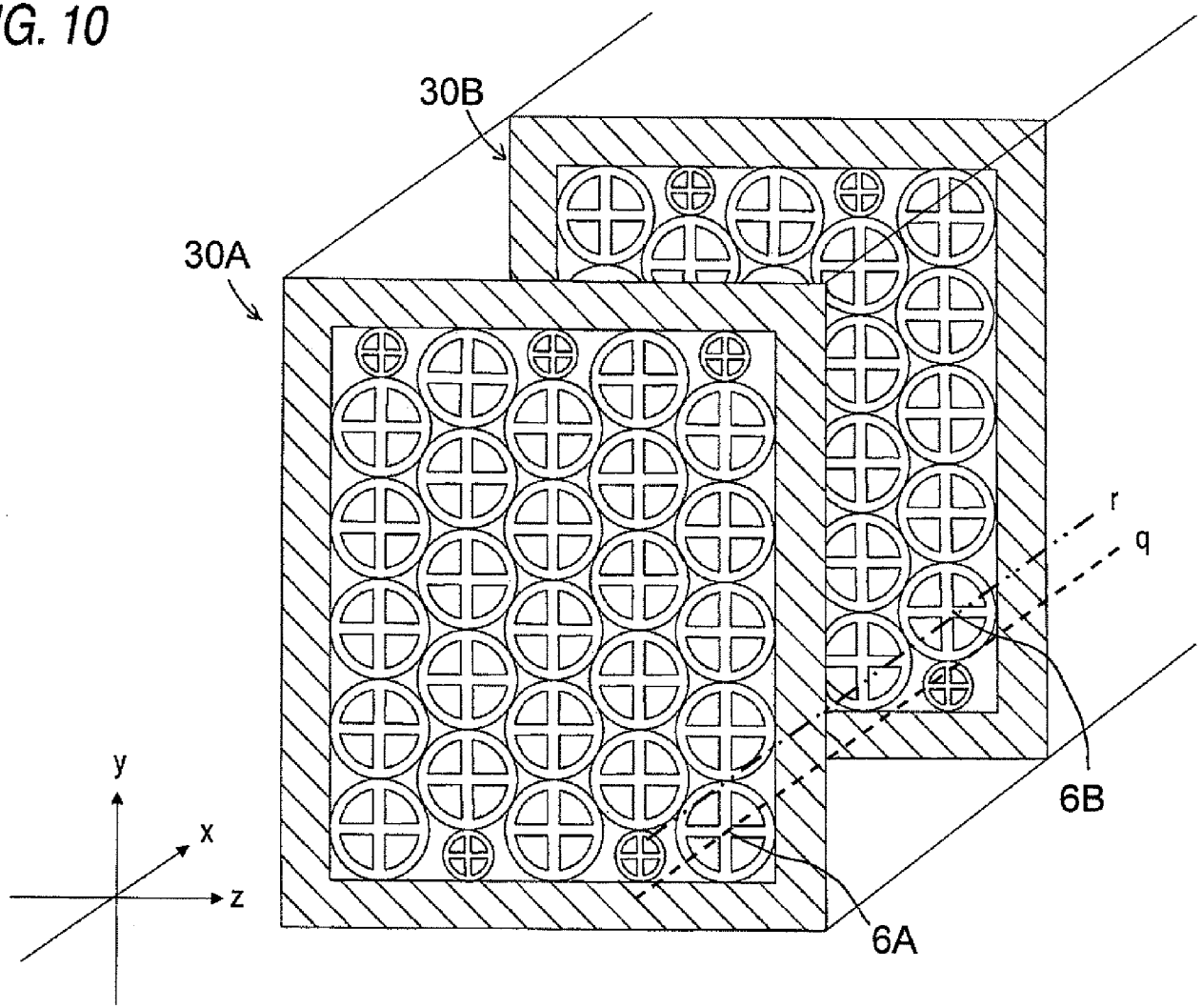
FIG. 10 is a view showing rectification units disposed along a common channel.
Figure 12:
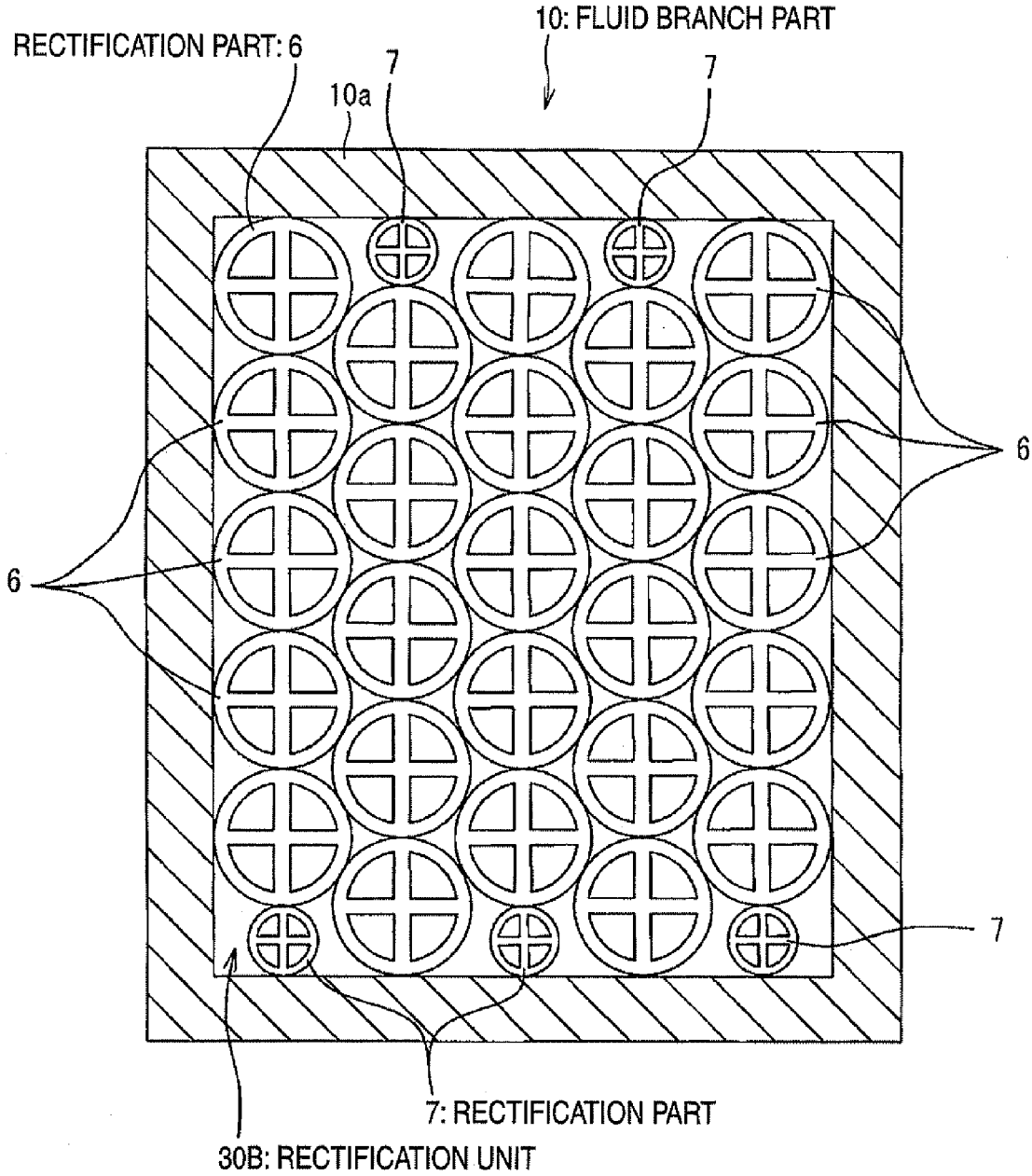
FIG. 12 is a sectional view along a D-D line in FIG. 8 as seen form a common channel (outlet) side of FIG. 8.

FIG. 8 is a sectional view showing a micro fluidic device according to a second exemplary embodiment of the invention; FIG. 9 is a sectional view along a C-C line in FIG. 8 as seen form a common channel (outlet) side of FIG. 8; and FIG. 12 is a sectional view along a D-D line in FIG. 8 as seen form a common channel (outlet) side of FIG. 8. In FIGS. 9 and 10, illustration of the rectifier plate 40 in each of rectification parts 6 and 7 is omitted.

In the present exemplary embodiment, rectification units 30A, 30B, 30C and 30D are arranged at fixed intervals in the flow direction of a fluid in place of the rectification unit 20 in the first exemplary embodiment shown in FIG. 2. The number of the rectification units 30A to 30D is to this four, but the number may be arbitrarily chosen.

The rectification units 30A and 30C each has a configuration shown in FIG. 9, and the rectification units 30B and 30D each has a configuration shown in FIG. 12. Each of the rectification units 30A to 30D is composed of five rows of rectification parts, and a single row is composed of five rectification parts 6 and one rectification part 7. The rectification unit 30A is provided with plural rectification parts 6 having the same structure and outer diameter of the rectifier plates 40 as in the rectification parts 4*a* to 4*p* and plural rectification parts 7 in which the structure of the rectifier plates 40 is the same, and the outer diameter thereof is substantially ½ of the rectification part 6.

As shown in FIG. 9, in the rectification units 30A and 30C, the rectification part 7 is disposed on the uppermost end of the five rectification parts 6 in a first row (row of the left-sided end); and the rectification part 7 is disposed on the lowermost end of the five rectification parts 6 in a second row (second row from the left side). Furthermore, a third row (center) and a fifth row (row of the right-sided end) have the same arrangement as the first row; and a fourth row has the same arrangement as the second row. By taking such a configuration, the adjacent rectification parts 6 are disposed in a close contact state with each other. The first introduction pipe 2 and the second introduction pipe 3 are connected to each of the rectification parts 6 of the rectification unit 30A, and a third introduction pipe 5 is connected to the rectification part 7.

FIG. 10 is a view showing rectification units disposed along a common channel. The rectification units 30A and 30B are disposed along the common channel in the direction of x shown in FIG. 10 (in an axis direction of the common channel) at a predetermined distance. In FIG. 10, rectification unit 30A is disposed as a former rectification unit and the rectification unit 30B is disposed as a latter rectification unit. The rectification parts 6 and 7 each of which belongs to the rectification unit 30A or 30B are arranged along a plane parallel to y-z plane shown in FIG. 10. The rectification parts 6 and 7 belonging to the rectification unit 30A (for example, 6A shown in FIG. 10) have center lines q (illustrated by dashed line in FIG. 10) which are parallel to x direction. In the same manner, the rectification parts 6 and 7 belonging to the rectification unit 30B (for example, 6B shown in FIG. 10) have center lines r (illustrated by dashed-two dotted line in FIG. 10) which are parallel to x direction. The center lines q and r described here are lines each passing through the center of the ring part 42 (See FIG. 4A) of the rectification part 6 or 7.

Figure 11:
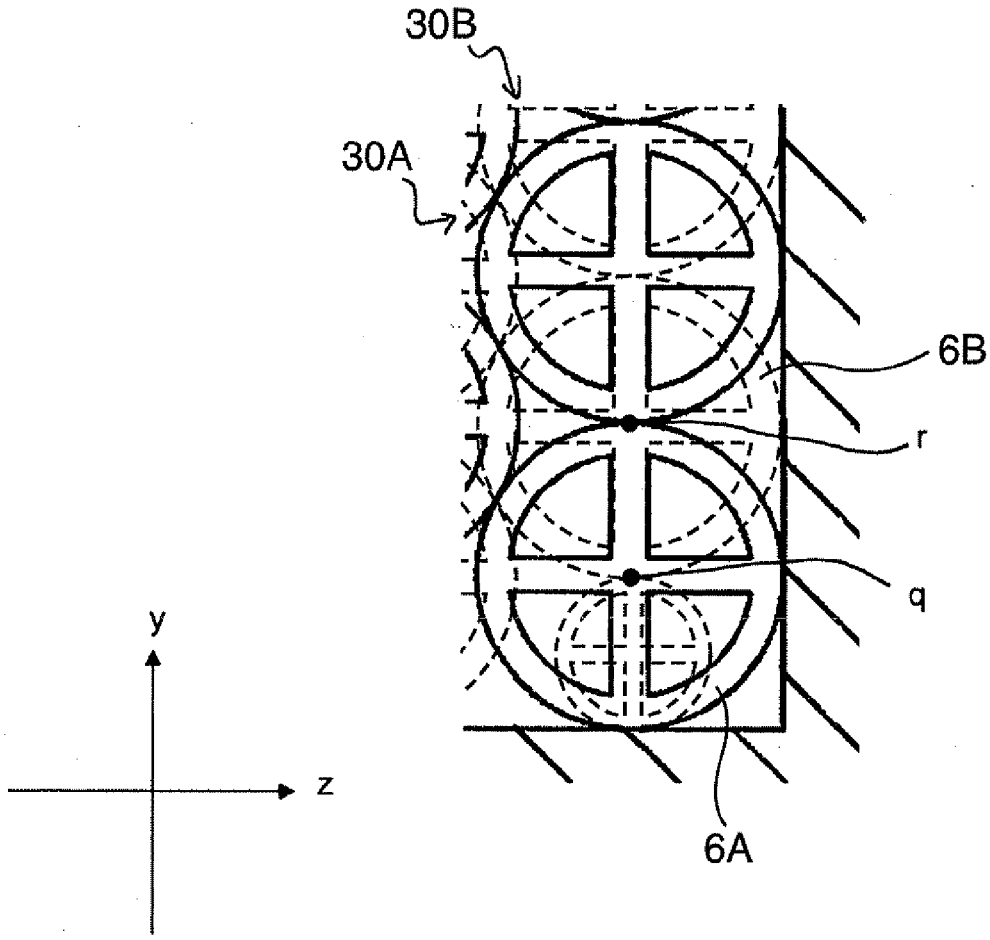
FIG. 11 is a view showing a part of the rectification units 30A and 30B of FIG. 10 toward x-direction of FIG. 10.

FIG. 11 is a view showing a part of the rectification units 30A and 30B of FIG. 10 toward x-direction of FIG. 10. In FIG. 11, the rectification part 6B of the latter rectification unit 30B is illustrated by dotted lines. Dots r and q shown in FIG. 11 correspond to the center lines r and q in FIG. 10, respectively.

The positions of the center lines q of the rectification parts 6 and 7 belonging to the rectification unit 30A are out of alignment with the center lines r of the rectification parts 6 and 7 belonging to the rectification unit 30B. In other wards, the center lines q do not overlap with the center lines r.

The above explanation is not limited to the arrangements of the rectification parts of the rectification units 30A and 30B, but is also applied to arrangements of rectification parts of another former rectification unit and another latter rectification unit (for example the arrangements of the rectification parts of the rectification unit 30B and the rectification unit 30C, or the like).

Figure 13:
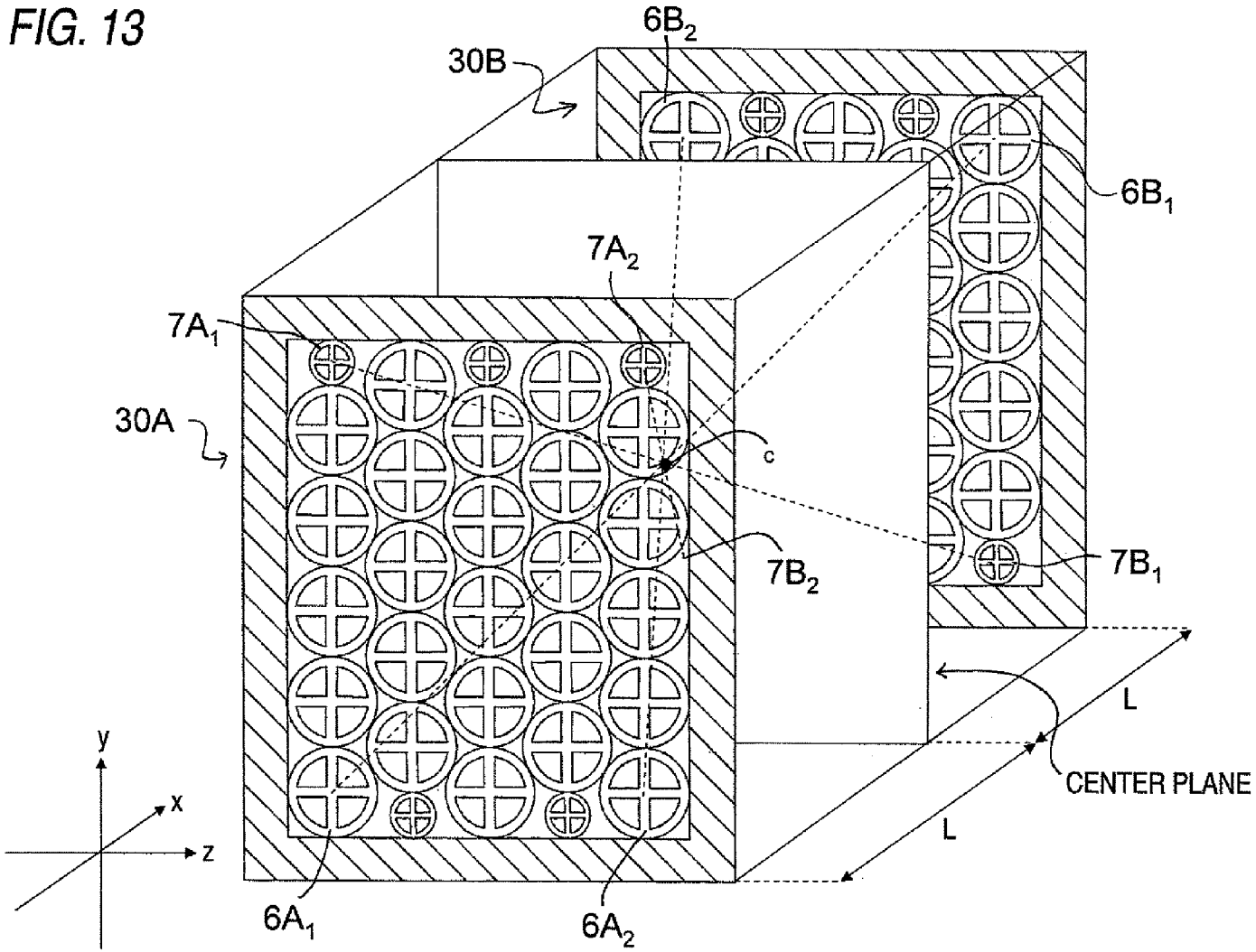
FIG. 13 is a view showing a positional relationship between rectification parts of the rectification unit 30A and rectification parts of the rectification unit 30B shown in FIG. 10.

Also, as shown in FIG. 12, in the latter rectification unit (30B and 30D, for example), the rectification parts 6 and 7 are located upside down with respect to the rectification parts 6 and 7 disposed in each of the rows of the former rectification unit 30A. FIG. 13 is a view showing a positional relationship between rectification parts of the rectification unit 30A and rectification parts of the rectification unit 30B shown in FIG. 10. In FIG. 13, a center plane is disposed between the rectification unit 30A and the rectification unit 30B, for purpose of illustration. A distance between the center plane and the rectification unit 30A and a distance between the center plane and the rectification unit 30B are equidistance L. The center plane intersects a center line of the common channel in the axis direction at a point c. As illustrated with dashed line in FIG. 13, the rectification parts $6B_1$, $6B_2$, $7B_1$ and $7B_2$ (the rectification part $7B_2$ is invisible in FIG. 13) of the latter rectification unit 30B and the rectification parts $6A_1$, $6A_2$, $7A_1$ and $7A_2$ of the former rectification unit 30A are symmetry with respect to the point c.

The above explanation is not limited to the arrangements of the rectification parts of the rectification units 30A and 30B, but is also applied to arrangements of rectification parts of another former rectification unit and another latter rectification unit (for example the arrangements of the rectification parts of the rectification unit 30B and the rectification unit 30C, or the like).

Since the action of the present exemplary embodiment is the same as in the first exemplary embodiment, its explanation is omitted.

[Other Exemplary Embodiments]

The invention is not limited to the foregoing respective exemplary embodiments, and various modifications may be made within the range where the gist of the invention is not changed. For example, a combination of constitutional elements among the respective exemplary embodiments may be arbitrarily made.

Also, in the foregoing respective exemplary embodiments, while the configuration where two fluids are mixed has been shown, the two fluids may be the same fluid, or may be a different fluid from each other. Also, there may be adopted a configuration where two or more fluids which are the same or different are mixed.

Also, the main body part of the fluid branch part or the common channel may be formed by laminating a thin film pattern.

[Third Exemplary Embodiment]

Figure 14:
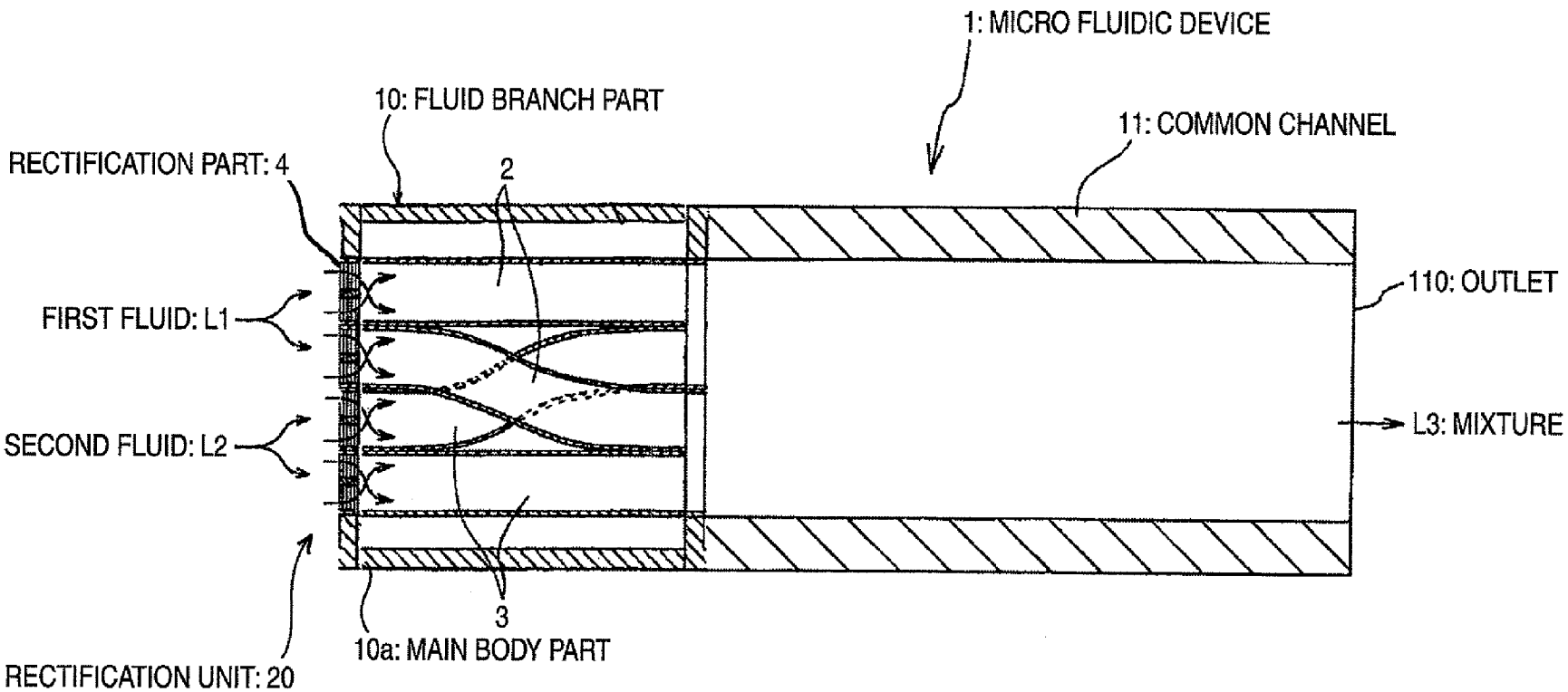
FIG. 14 is an example of side view showing a micro fluidic device according to a third exemplary embodiment of the invention.

FIG. 14 is an example of side view showing a micro fluidic device according to a third exemplary embodiment of the invention.

In the foregoing respective exemplary embodiments, while the configuration where a flow is branched in a fluid branch part such that two fluids flow adjacent to each other, and a helical flow is then generated in each of the fluids in a rectification part has been shown, there may be adopted a configuration where a helical flow is generated in advance in each fluid in a rectification part, the flow is then branched in a fluid branch part such that two fluids flow adjacent to each other, and the two fluids are mixed in a merging channel, as shown in FIG. 14.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A micro fluidic device comprising:

a plurality of first introduction pipes into which only a first fluid is introduced;

a plurality of second introduction pipes into which only a second fluid is introduced, each second introduction pipe being-disposed adjacent to first introduction pipes;

a common channel connected to the plurality of first introduction pipes and to the plurality of second introduction pipes;

a first group of rectification parts, each rectification part of the first group of rectification parts being provided individually for each first introduction pipe and for each second introduction pipe, the first group of rectification parts generating a helical flow in the first fluid and a helical flow in the second fluid; and a second group of rectification parts different from the first group of rectification parts, the second group of rectification parts placed at a prescribed interval away from the first group of rectification parts in an axis direction of the common channel, wherein a line passing through the center of a rectification part in the first group of rectification part and a rectification part in the second group of rectification parts is not parallel to the axis direction, wherein the first fluid and the second fluid are mixed in the common channel, the helical flow in the first fluid and the helical flow in the second fluid have a same circumferential direction, each rectification part of the first group of rectification parts and each rectification part of the second group of rectification parts includes a plurality of rectifier plates, the plurality of rectifier plates being stacked, and each rectifier plate of the plurality of rectifier plates in each rectification part is configured with an orientation that is shifted by a nonzero degree angle with respect to an orientation of an adjacent rectifier plate.

2. The micro fluidic device according to claim 1, wherein each rectifier plate of the plurality of rectifier plates in each of the respective rectification parts being further configured to have a cross-shaped part and a ring part.

3. The micro fluidic device according to claim 1, wherein a certain plane is located between the first rectification parts and the second rectification parts, a distance between the certain plane and the first rectification parts is equal to that between the certain plane and the second rectification parts, and positions of the first rectification parts and positions of the second rectification parts are symmetry with respect to a point at which the certain plane intersects a center line of the common channel.

4. The micro fluidic device according to claim 1, wherein rectification parts of the first group are located upstream of the first introduction pipe and the second introduction pipe in a flowing direction of the first fluid and the second fluid.

5. The micro fluidic device according to claim 1, wherein rectification parts of the first group are located downstream of the first introduction pipe and the second introduction pipe in a flowing direction of the first fluid and the second fluid.

6. A micro fluidic device comprising:

a first introduction pipe into which only a first fluid is introduced;

a second introduction pipe into which only a second fluid is introduced, the second introduction pipe being disposed adjacent to the first introduction pipe;

a common channel connected to the first introduction pipe and the second introduction pipe;

a first group of rectification parts, each rectification part of the first group of rectification parts being provided individually for the first introduction pipe; and a second group of rectification parts, each rectification part of the second group of rectification parts being provided individually for the second introduction pipe, wherein each rectification part of the first group of rectification part generates a helical flow in the first fluid, each rectification part of the second group of rectification part generates a helical flow in the second fluid, the helical flow in the first fluid and the helical flow in the second fluid have a same circumferential direction, the first fluid and the second fluid are mixed in the common channel, each rectification part of the first group of rectification parts is disposed adjacent to a rectification part of the second group of rectification parts in a first direction perpendicular to an axis direction of the common channel, each rectification part of the first group of rectification parts and each rectification part of the second group of rectification parts includes a plurality of rectifier plates, the plurality of rectifier plates being stacked, and each rectifier plate of the plurality of rectifier plates in each rectification part is configured with an orientation that is shifted by a nonzero degree angle with respect to an orientation of an adjacent rectifier plate.

7. The micro fluidic device according to claim 1, wherein the first group of rectification parts and the second group of rectification parts each include rectification parts with a first diameter and other rectification parts with a second diameter that is smaller than the first diameter.

8. The micro fluidic device according to claim 6, wherein rectification parts of the first group of rectification parts and rectification parts of the second group of rectification parts alternate in position in the first direction perpendicular to the axis direction of the common channel and in a second direction that is perpendicular to the first direction and perpendicular to the axis direction of the common channel, each rectification part of the first group of rectification parts is disposed adjacent to a rectification part of the second group of rectification parts in a direction perpendicular to an axis direction of the common channel.

* * * * *